United States Patent [19]

Tiritilli

[11] 4,127,943

[45] Dec. 5, 1978

[54] GUN SIGHT

[76] Inventor: Leonard A. Tiritilli, 631 E. Norman Ave., Arcadia, Calif. 91006

[21] Appl. No.: 826,469

[22] Filed: Aug. 22, 1977

[51] Int. Cl.[2] ..... F41G 1/28

[52] U.S. Cl. ..... 33/260

[58] Field of Search ..... 33/259, 260, 234, 257, 33/233

[56] References Cited

U.S. PATENT DOCUMENTS

| | | | |
|---|---|---|---|
| Re. 14,009 | 11/1915 | Warner | 33/259 |
| 1,206,060 | 11/1916 | Warner | 33/259 |
| 2,345,553 | 4/1944 | Brown et al. | 33/259 |

*Primary Examiner*—Richard E. Aegerter

*Attorney, Agent, or Firm*—Christie, Parker & Hale

[57] ABSTRACT

A gun sight includes a gun sight body having a fixed front sight and a movable rear sight leaf having a rear sight for being aligned with the front sight when shooting. The gun sight body has a rotatable cam with a series of spaced apart camming surfaces, and the sight leaf has a series of independently adjustable cam followers for being engaged by corresponding camming surfaces. Rotation of the cam sequentially moves each camming surface into contact with a corresponding cam follower to move the level of the rear sight between a plurality of fixed positions with respect to the front sight. The cam followers are independently adjustable to provide settings for selected target distances, and the cam can be releasably locked in a plurality of set positions which are indexed to indicate the target distances associated with the settings of the corresponding cam followers. Preferably, the rear sight can be moved to each preset position during a single rotation of the cam.

22 Claims, 6 Drawing Figures

GUN SIGHT

BACKGROUND

This invention relates to gun sights, and more particularly to a gun sight which can be quickly and easily moved between a number of preset positions for use in shooting at targets of different distances from the shooter.

In target shooting a commonly used gun sight has a fixed front sight and a movable rear sight leaf having a rear sight to be aligned with the front sight when shooting. The rear sight leaf is moved up or down to change the elevation of the rear sight in accordance with the range of the target at which the gun is fired.

In a common type of target shooting, there are three stages of fire at targets located at 7, 25, and 50 yards from the target shooter. The shooter is required to make adjustments in the rear sight in accordance with the distance of each target. During competition there is a limited amount of time between shooting intervals, so each sight adjustment should be made quickly and accurately for the shooter to obtain a high score.

One commonly used gun sight requires a shooter to make sight adjustments by rotating a screw on the gun sight as many as six revolutions to move the rear sight from one setting to the next setting. Such a gun sight sometimes results in erroneous sight adjustments because, under the pressure of competition, the shooter can easily turn the adjustment screw in the wrong direction, or fail to turn it the required number of revolutions.

The present invention provides an improved gun sight which substantially eliminates these problems. The gun sight of this invention can be quickly and easily moved between finely adjusted preset positions corresponding to the range of the target for each stage of fire, which essentially eliminates the chances of error in making sight adjustments.

SUMMARY OF THE INVENTION

Briefly, the present invention provides a gun sight comprising a gun sight body, a sight leaf movably secured to the gun sight body, a plurality of separate camming surfaces for cooperating with corresponding independently adjustable cam followers, and means for separately moving each camming surface into engagement with a respective cam follower for moving the sight leaf relative to the gun sight body to position the sight leaf in a plurality of selected positions with respect to the gun sight body.

In a preferred form of the invention, the camming surfaces are arranged in series along the length of a cam rotatably secured to the gun sight body. The cam followers are rotatably secured to the sight in series adjacent corresponding camming surfaces. Rotation of each cam follower relative to the sight leaf adjusts the position of the cam follower relative to its corresponding camming surface. Rotation of the cam rotates each camming surface sequentially into contact with a respective cam follower to sequentially adjust the position of the sight leaf relative to the gun sight body. The position of each cam follower relative to its corresponding camming surface controls the distance through which the sight leaf is moved relative to the gun sight body when making each sight adjustment.

The cam can be arranged so that each camming surface is moved into engagement with a corresponding cam follower during a single 360° rotation of the cam. The cam can be releasably locked into the positions in which a given cam follower engages a corresponding camming surface. Thus, the cam can be rotated through only a fraction of a rotation between separate locked positions to make sight adjustments corresponding to targets of different distance from the shooter.

Hence, the gun sight provides means for making a fine adjustment at each of a multiple number of target range settings; and the shooter can preset the gun sight in each of the finely adjusted positions so that sight adjustments can be made quickly and accurately during competition.

These and other aspects of the invention will be more fully understood by referring to the following detailed description and the accompanying drawings.

DRAWINGS

DETAILED DESCRIPTION

Figure 1:
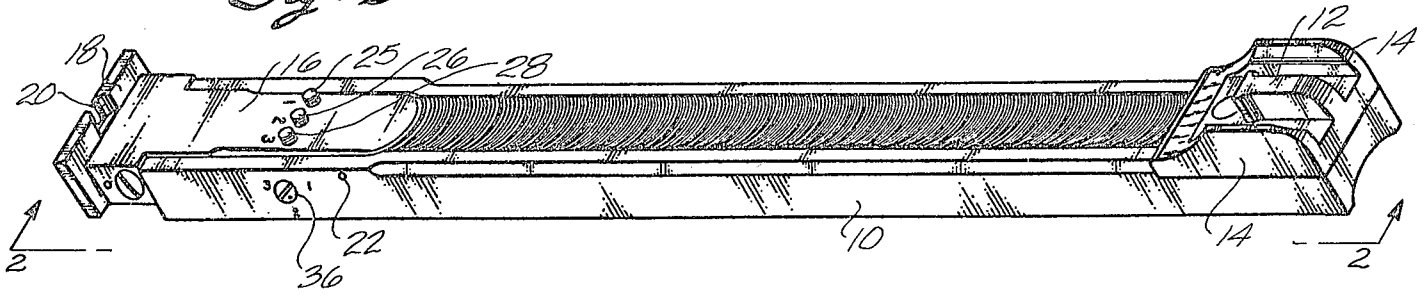
FIG. 1 is a perspective view showing a gun sight according to principles of this invention.
Figure 2:
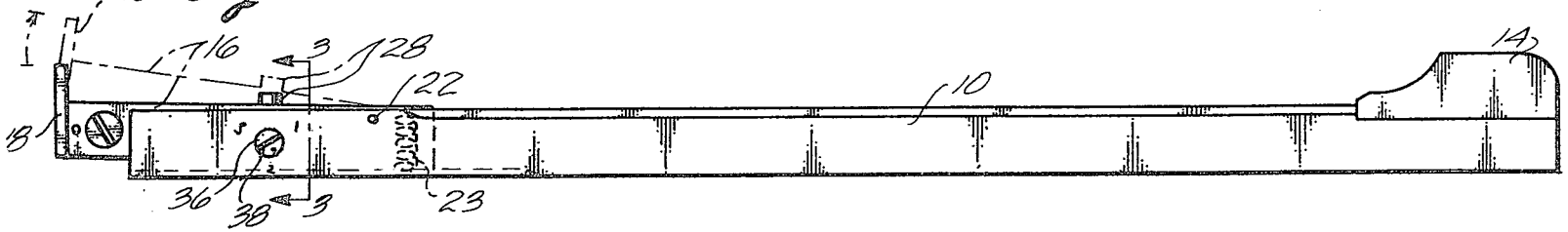
FIG. 2 is a side elevation view taken on line 2—2 of FIG. 1.

Referring to the drawings, a gun sight includes a gun sight body 10 having a fixed front sight 12 and a pair of guards 14 spaced from opposite sides of the front sight 12. Such a gun sight body typically has holes spaced along its length for receiving fasteners for securing the gun sight to the barrel of a gun. The fastener holes are not shown in the drawings for simplicity.

The gun sight body includes a movable sight leaf 16 having a rear sight 18 at the end of the gun sight body located most remote from the front sight 12. The rear sight 18 includes a sight notch 20 through which the shooter aligns the front sight 12 when aiming at a target. The sight leaf 16 is secured to the gun sight body 10 by a pivot pin 22 which enables the sight leaf to rotate about the axis of the pivot pin. A coil spring 23 located under the sight leaf on the side of the pivot pin 22 closest to the front sight 12 normally biases the sight leaf into engagement with a sight-adjusting cam described below. Rotation of the sight leaf relatve to the gun sight body 10 adjusts the elevation of the sight notch 20 relative to the front sight 12. This provides adjustments in the setting of the gun sight for shooting at targets of different distances from the shooter. Thus, for example, as the sight leaf 16 is raised to increase the elevation of the rear sight notch 20 relative to the front sight 12, the gun sight is correspondingly adjusted for targets closer and closer to the shooter.

The gun sight shown in the drawings can be used in a type of target shooting competition in which there are targets located at three separate different distances from the shooter. Sight adjustments are made by use of a rotatable cam 24 which extends across the width of the gun sight body beneath the sight leaf 16. The sight leaf has a series of first, second, and third cam followers 25, 26, and 28, located above respective first, second and third camming surfaces 30, 32, and 34 (see FIGS. 3 and 4) on the cam 24.

The cam 24 has a cam-adjustment head 36 with a notch 38 for receiving a screwdriver used to rotate the cam on its axis between each of the three set positions of the cam. The cam followers 25, 26, and 28 preferably are threaded shafts which are threaded into corresponding internally threaded bores in the sight leaf 16.

Each cam follower can be rotated to adjust its position relative to its corresponding camming surface independently of the other cam followers. Each cam follower has a notch for receiving a screwdriver or an Allen head wrench used to rotate the cam follower on its axis. Rotation of each cam follower raises or lowers its elevation with respect to its corresponding camming surface. When the cam 24 is rotated about its axis, the first, second, and third camming surfaces are sequentially moved into engagement with the first, second, and third cam followers, respectively. This movement of the cam pivots the sight leaf about the axis through the pivot pin 22, and when each cam follower engages its corresponding camming surface, the sight leaf is automatically positioned in a preset position established by the position of the cam follower with respect to its camming surface. The cam is preferably machined so each one-third revolution of the cam will engage a given camming surface, in sequence, with its respective cam follower.

The cam followers are independently adjustable so that each cam follower can be preset in accordance with the range of the target associated with each selected position of the cam. Thus, the first, second, and third cam followers 25, 26, and 28 can be independently positioned to preset the rear sight leaf for target distances of say 7, 25, and 50 yards, so that rotation of the cam between its three present positions will sequentially engage the first, second, and third camming surfaces 30, 32 and 34 with their corresponding cam followers to move the rear sight leaf, in sequence, into alignment with the front sight for aiming at targets of 7, 25, and 50 yards, respectively.

The cam 24 and the cam followers shown in the drawings are arranged so that the first, second, and third positions correspond to targets 7, 50, and 25 yards from the shooter; but the gun sight can be arranged to provide a different number of preset sight positions, or to accommodate targets of different distances, without departing from the scope of the invention.

Figure 3:
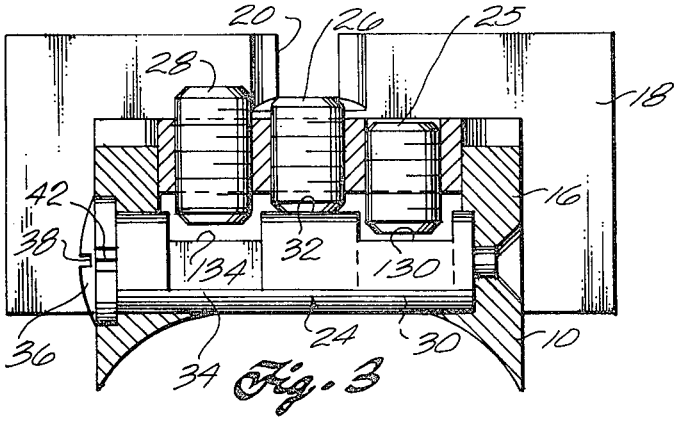
FIG. 3 is a cross-sectional elevation view taken on line 3—3 of FIG. 2.

As shown best in FIG. 3, the cam 24 is machined to provide two spaced apart recessed regions 130 and 134 for receiving the first and third cam followers 25 and 28 when they are not in contact with their respective camming surfaces 30 and 34. FIG. 3 shows the second cam follower 26 in contact with the second camming surface 32 of the cam. This is the operative position of the second cam follower and its camming surface in which they are controlling the position of the rear sight in accordance with the target distance for which the second cam follower 26 is preset. Alternatively, the cam could be machined with lobes projecting from the main body of the cam for contacting the cam followers, as opposed to providing the recessed regions 130 and 134, although the structure shown in the drawings is preferred because it better accommodates the narrow space limitations between the gun sight body and the underside of the sight leaf.

Figure 5:
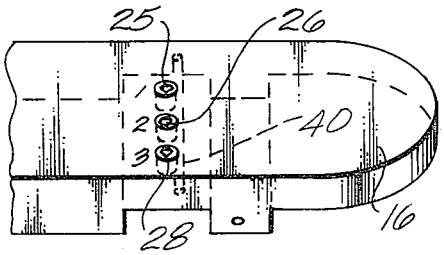
FIG. 5 is a fragmentary perspective view showing means for frictionally holding sight-adjusting cam followers in their fixed positions.

Referring to FIG. 5, the cam followers 25, 26, and 28 are pressure-locked into position to prevent them from rotating loose once they are set. A transverse nylon filament 40, or the like, extends through the sight leaf 16 and portions of the threaded holes which hold the cam followers. The nylon filament produces friction on the sides of the cam followers which resists their tendency to rotate, and thus provides a pressure lock which holds the cam followers in place once they are set.

The side of the gun sight body 10 is indexed adjacent to the head 36 of the cam 24 to indicate the stage of fire associated with each setting of the cam. For example, in the gun sight shown in the drawings which is used for competition having three stages of fire, the cam is indexed so that it has three set positions for each 360° rotation of the cam. One-third revolution of the cam moves the cam from one set position to the next. The three set positions of the cam are indexed by the numerals 1, 2 and 3, adjacent the head 34 of the cam 24 to indicate the first, second, and third stages of fire, respectively. Similarly, the sight leaf 16 is indexed adjacent the three cam followers 25, 26, and 28 for indicating the particular cam follower which is operative during each stage of fire. The first, second, and third cam followers 25, 26, and 28 are indexed by the numerals 1, 2, and 3, respectively, indicating that for the first stage of fire, for example, when the cam is rotated to the position indicated by the numeral 1, the first camming surface 30 is engaged by the first cam follower 25, also indicated by the numeral 1, which indicates to the shooter that the sight leaf is moved to the preset position for the first stage of fire. Likewise, when the cam is rotated to the position indicated by the numeral 2, the second camming surface 32 is engaged by the second cam follower 26 indicated by the numeral 2, which indicates that the rear sight is moved to the preset position for the second stage of fire, and so on.

Figure 4:
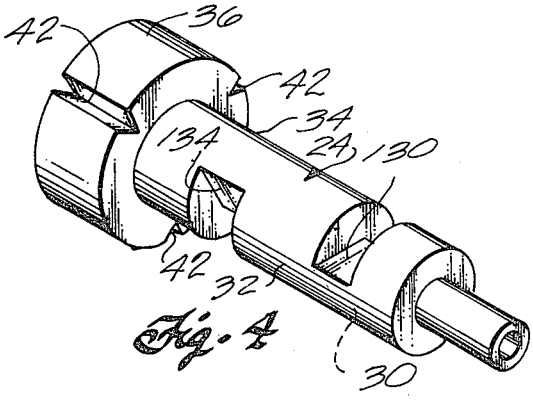
FIG. 4 is a perspective view showing a sight-adjusting cam according to this invention.
Figure 6:
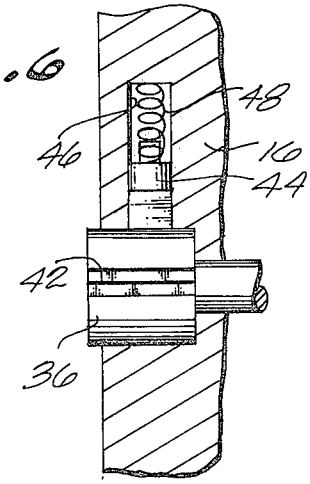
FIG. 6 is a fragmentary cross-sectional view illustrating a mechanism for releasably locking the sight-adjusting cam in each of a number of set positions.

Referring to FIGS. 4 and 6, the cam 24 is arranged to be frictionally held in each of its three set positions. This ensures that the shooter will know precisely when the sight leaf 16 is in the correct preset position for each stage of fire. The head 36 of the cam 24 has three longitudinally extending and equidistantly spaced apart notches 42 extendng around its perimeter. The notches 42 are engaged by a plunger 44 located in a bore 46 in the side of the gun sight body adjacent the head 36 of the cam. The plunger 44 has a pointed end which can slip into each notch 42 when the cam 24 is rotated. A coil spring 48 biases the plunger toward the head 36 of the cam. When the shooter rotates the cam, the plunger 44 is released from engagement with one notch 42 and rides on the outer surface of the head 36 until the cam is moved to the next indexed position, whereupon the plunger 44 snaps into engagement with the next notch 42. Thus, the cam will click into each preset position to indicate to the shooter when the cam is rotated to each preset position.

Thus, the present invention provides a gun sight which minimizes the chances of error during competition by avoiding complicated sight adjustments. The gun sight is preset for a fixed number of firing distances, and the shooter can make a fine adjustment to preset the sight for each firing distance. Moreover, the gun sight is structured so that a multiple number of sight adjustments can be made accurately by merely rotating a cam a fraction of the rotation for each target setting. The cam is indexed to clearly identify when the sight is set for each stage of fire. This assures the shooter that the gun sight is accurately positioned in the finely adjusted preset position for each target distance.

The present invention has been described in the context of a gun sight having a gun sight body with a fixed front sight and a rear sight on a movable rear sight leaf. However, it should be understood that the invention can be used in a gun sight body in which the rear sight is fixed and the invention is used to make adjustments in a movable front sight. Further, the invention can be used in a gun sight body in which the front and rear sights are separated, i.e., each is independently positioned on the gun barrel. For example, the gun sight body could mount only a rear sight leaf having the sight adjustment means of this invention, and the front sight could be separate from such a rear sight; or the adjustment means of this invention could be used in an adjustable front sight which is separate from a fixed rear sight.

I claim:

1. A gun sight comprising a gun sight body; a sight leaf movably secured to the gun sight body; a movable cam between the gun sight body and the sight leaf; a plurality of movable cam followers, each cam follower being independently movable toward or away from the cam; and means for moving the cam into a plurality of predetermined positions for separately engaging each cam follower for providing separate adjustments in the elevation of the sight leaf relative to the gun sight body, each elevation adjustment being independently controllable by the movement of a respective cam follower relative to the cam.

2. Apparatus according to claim 1 in which the cam is rotatable, and including a plurality of camming surfaces on the cam; and including detent means for being engaged with corresponding slots in the rotatable cam when the cam is rotated to positions in which a corresponding camming surface engages a respective cam follower.

3. Apparatus according to claim 2 including means for releasably spring biasing the detent means into engagement with each slot.

4. Apparatus according to claim 3 in which a single 360° rotation of the cam moves a plurality of such camming surfaces into engagement with a correspondng plurality of cam followers.

5. Apparatus according to claim 1 in which the cam followers are rotatable independently of one another; and including friction means engaged with each cam follower to frictionally hold each cam follower in a selected rotational position.

6. Apparatus according to claim 5 in which the cam followers comprise threaded shafts; and the friction means comprise a transverse friction member engaged with the threaded shafts to apply a frictional force to each threaded shaft which tends to resist rotational movement of the threaded shafts.

7. Apparatus according to claim 1 in which the gun sight body has a fixed first sight; and the sight leaf has a second sight which is movable in elevation relative to the gun sight body in response to corresponding movement of the sight leaf so that said separate adjustments in the elevation of the sight leaf moves the second sight relative to the first sight.

8. Apparatus according to claim 1 including a plurality of camming surfaces on the cam, and means for rotating the cam into a plurality of selected positions; and in which the cam, in each of such selected positions, is operative to move a respective camming surface into engagement with a corresponding cam follower to provide a plurality of independent adjustments of the elevation of the sight leaf through the separate rotational positions of the cam.

9. Apparatus according to claim 1 including a plurality of camming surfaces on the cam; and in which the cam followers are spearately rotatable for independently adjusting the position of each follower relative to a corresponding camming surface; and including means for sequentially moving the camming surfaces into engagement with their respective cam followers to separately adjust the elevation of the sight leaf, relative to the gun sight body, in sequence in response to each sequential engagement of a camming surface and its corresponding cam follower.

10. Apparatus according to claim 1 including a plurality of camming surfaces on a single rotatable cam; and in which a single 360° rotation of the cam moves a plurality of such camming surfaces into engagement with a corresponding plurality of cam followers.

11. A gun sight comprising a gun sight body; a sight leaf movably secured to the gun sight body; a movable cam between the sight leaf and the gun sight body; a plurality of mutually spaced apart cam followers between the sight leaf and the gun sight body; means for freely and independently positioning each cam follower relative to the cam; and means for moving the cam into a plurality of separate preselected positions for controlling the elevation of the sight leaf relative to the gun sight body, the cam in each preselected position being engageable with a corresponding cam follower while providing clearance between the cam and each remaining cam follower, engagement of the cam with each cam follower holding the sight leaf at a corresponding elevation with respect to the gun sight body, in which said corresponding elevation is independently controlled by the positioning of the cam follower relative to the cam.

12. Apparatus according to claim 11 in which the means for positioning each cam follower comprises a separate shaft for being rotated on its axis to move toward or away from the cam.

13. Apparatus according to claim 12 in which the cam has a separate recess adjacent each cam follower for providing clearance for each cam follower.

14. Apparatus according to claim 13 in which the cam is rotatable about an axis essentially perpendicular to the axis of each cam follower.

15. Apparatus according to claim 14 in which the cam followers are on the sight leaf and the cam is on the gun sight body.

16. A gun sight comprising a gun sight body; a sight leaf movably secured to the gun sight body; a plurality of independently adjustable cam followers on the sight leaf; a rotatable cam having a plurality of camming surface each for cooperating with a corresponding cam follower; means for separately moving each cam follower relative to the sight leaf for independently adjusting the elevation of the sight leaf relative to the gun sight body in response to engagement between each cam follower and a correspondng camming surface; and means for rotating the cam into a plurality of selected positions, the cam in each selected position moving a respective camming surface into engagement with a corresponding cam follower for providing a plurality of independent adjustments of the elevation of the sight leaf with respect to the gun sight body.

17. Apparatus according to claim 16 in which each cam follower comprises a threaded shaft, and means for rotating each threaded shaft to adjust the position of each shaft relative to the position of corresponding camming surface on a rotatable cam.

18. Apparatus according to claim 17 including respective indicia for each cam follower, and corresponding indicia for identifying the respective rotational positions of the cam in which the respective camming surfaces are engaged with their corresponding cam followers.

19. A gun sight comprising a gun sight body; a sight leaf movably secured to the gun sight body; a cam rotatably secured to the gun body, the cam having a series of camming surfaces arranged in series along the length of the cam; a plurality of cam followers rotatably secured to the sight leaf in series adjacent corresponding camming surfaces, rotation of each cam follower relative to the sight leaf adjusting the position of the cam follower relative to its corresponding camming surface; and means for rotating the cam for sequentially rotating each camming surface into engagement with a corresponding cam follower for independently adjusting the position of the sight leaf relative to the gun body, the position of each cam follower relative to its corresponding camming surface controlling the amount of movement of the sight leaf relative to the gun sight body.

20. Apparatus according to claim 19 in which the gun sight body has a fixed first sight; and the sight leaf has a second sight which is movable with corresponding movement of the sight leaf so that positioning of the sight leaf in said plurality of selected positions moves the second sight relative to the first sight.

21. Apparatus according to claim 20 in which a single 360° rotation of the cam moves a plurality of such camming surfaces into engagement with a corresponding plurality of cam followers.

22. Apparatus according to claim 21 including respective indicia for each cam follower, and corresponding indicia for identifying the respective rotational positions of the cam in which the respective camming surfaces are engaged with their corresponding cam followers.

* * * * *

UNITED STATES PATENT AND TRADEMARK OFFICE

CERTIFICATE OF CORRECTION

PATENT NO. : 4,127,943

DATED : December 5, 1978

INVENTOR(S) : LEONARD A. TIRITILLI

It is certified that error appears in the above-identified patent and that said Letters Patent are hereby corrected as shown below:

Col. 2, line 53, "relatve" should read -- relative --.

Col. 3, line 37, "present" should read -- preset --.

Col. 5, line 43, "correspondng" should read -- corresponding --

Col. 6, line 55, "surface" should read -- surfaces --.

Col. 7, line 12, "gun body" should read -- gun sight body --.

Col. 8, line 1, "gun body" should read -- gun sight body --.

Signed and Sealed this

*Third* Day of *April 1979*

[SEAL]

*Attest:*

RUTH C. MASON
*Attesting Officer*

DONALD W. BANNER
*Commissioner of Patents and Trademarks*